US005940655A

United States Patent [19]

Sano et al.

[11] Patent Number: 5,940,655

[45] Date of Patent: Aug. 17, 1999

[54] IMAGE HEATING APPARATUS

[75] Inventors: Tetsuya Sano; Hiroshi Mano, both of Numazu; Atsuyoshi Abe, Susono; Kiyofumi Nakane, Abiko, all of Japan

[73] Assignee: Canon Kabushiki Kaisha, Tokyo, Japan

[21] Appl. No.: 08/938,842

[22] Filed: Sep. 26, 1997

[30] Foreign Application Priority Data

Sep. 27, 1996 [JP] Japan ..... 8-256275

[51] Int. Cl.[6] ..... G03G 15/20

[52] U.S. Cl. ..... 399/69; 399/328

[58] Field of Search ..... 399/67, 69, 320, 399/321, 328, 329, 330, 335; 219/216; 374/183

[56] References Cited

U.S. PATENT DOCUMENTS

| | | | |
|---|---|---|---|
| 4,570,044 | 2/1986 | Kobayashi et al. | 219/216 X |
| 5,088,836 | 2/1992 | Yamada et al. | 374/183 |
| 5,499,088 | 3/1996 | Menjo | 399/321 |
| 5,526,103 | 6/1996 | Kato et al. | 399/328 |
| 5,552,582 | 9/1996 | Abe et al. . | |
| 5,568,240 | 10/1996 | Ohtsuka | 399/335 |
| 5,752,148 | 5/1998 | Yoneda et al. | 399/329 |

FOREIGN PATENT DOCUMENTS

| | | |
|---|---|---|
| 62-150371 | 7/1987 | Japan . |
| 5-9027 | 2/1993 | Japan . |
| 7-114276 | 5/1995 | Japan . |

*Primary Examiner*—Sandra Brase
*Attorney, Agent, or Firm*—Fitzpatrick, Cella, Harper & Scinto

[57] ABSTRACT

An image heating apparatus includes a movable member which is movable with a recording material; magnetic flux generating means for generating a magnetic flux, wherein the magnetic flux generated by the magnetic flux generating means generates an eddy current which in turn generates heat in the movable member to heat an image an a recording material; and a temperature detecting member for detecting a temperature of the movable member, wherein the temperature detecting member is provided outside a predetermined heat generation region of the movable member.

31 Claims, 8 Drawing Sheets

(a)

(b)

IMAGE HEATING APPARATUS

FIELD OF THE INVENTION AND RELATED ART

The present invention relates to a heating apparatus suitable for a fixing apparatus which is employed in an image forming apparatus such as an electrophotographic apparatus, an electrostatic recording apparatus, or the like to fix a toner image, which has been simply deposited on the recording medium, to a recording medium.

Prior to the present invention, a typical fixing apparatus has been a thermal fixing apparatus employing an image heating apparatus based on a contact type heating system, for example, a thermal roller type heating system or a film type heating system, which comprises a heat generating member such as a halogen lamp, a heat generating resistor, or the like, and a roller or a piece of film. In this type of image heating apparatus, a toner image is heated through the roller or the film by the heat generated by flowing electric current through the halogen lamp, the heat generating resistor, or the like.

Japanese Patent Publication Application No. 9027/1993 proposes an apparatus which heats an object with the use of a fixing roller heated by Joule heat. However, this apparatus is different from the apparatuses prior to it in that the Joule heat which heats the fixing roller is generated by the eddy current induced in the fixing roller with the use of magnetism.

This type of heating apparatus which uses eddy current allows the heat source to be placed closer to a toner image, and therefore, is more efficient in terms of energy consumption, compared to a conventional heating apparatus employing the aforementioned halogen lamp or the like. Further, Japanese Laid-Open Patent Application No. 114276/1995 proposes a fixing apparatus based on a heating system, in which in order to further improve thermal efficiency, eddy current is induced in a piece of thin film, and the Joule heat generated in this thin film is used to heat an object.

As for a method for controlling the temperature of these image heating apparatuses, the temperature of the fixing roller or the fixing film is to be adjusted to a proper image fixation temperature in response to the temperature of the fixing roller or the fixing film, which is detected with the use of a temperature detecting member such as a thermistor.

However, the temperature detected by a temperature detecting member such as a thermistor or the like does not always reflect the accurate temperature of the heating roller or the heating film, because the responsiveness of a temperature detecting member to the changes in ambient conditions is greatly affected by the location of the temperature detecting member (thermistor). Therefore, a problem such as fixation failure or the like is liable to occur.

In particular, when a pre-fixation image composed of a plurality of toner layers, for example, a full-color toner image, is to be fixed to a cardboard or the like which has been left cold, an ample amount of heat is necessary to fix the image. Therefore, a large amount of heat is robbed from the fixing roller (or film), and as a result, the temperature thereof greatly decreases. In this situation, if the responsiveness of the image heating apparatus (fixing apparatus) to the changes in ambient temperature is inferior, the changes in ambient temperature cannot be accurately reflected, and as a result, a delay occurs in temperature control. Therefore, the heating member is liable to run short of heat by the time the trailing end of a recording sheet reaches the heating member, which causes fixation failure.

SUMMARY OF THE INVENTION

The object of the present invention is to provide an image heating apparatus comprising a temperature detecting member capable of accurately detecting the temperature of a moving member in which heat is generated by magnetism.

Another object of the present invention is to provide an image heating apparatus comprising a temperature detecting member which is disposed outside the predetermined heat generating range of a moving member in which heat is generated by magnetism.

Another object of the present invention is to provide an image heating apparatus in which a temperature detecting member is disposed outside the magnetic flux path formed through a moving member in which heat is generated by magnetism, and a magnetic member which guides magnetic flux.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Figure 8:
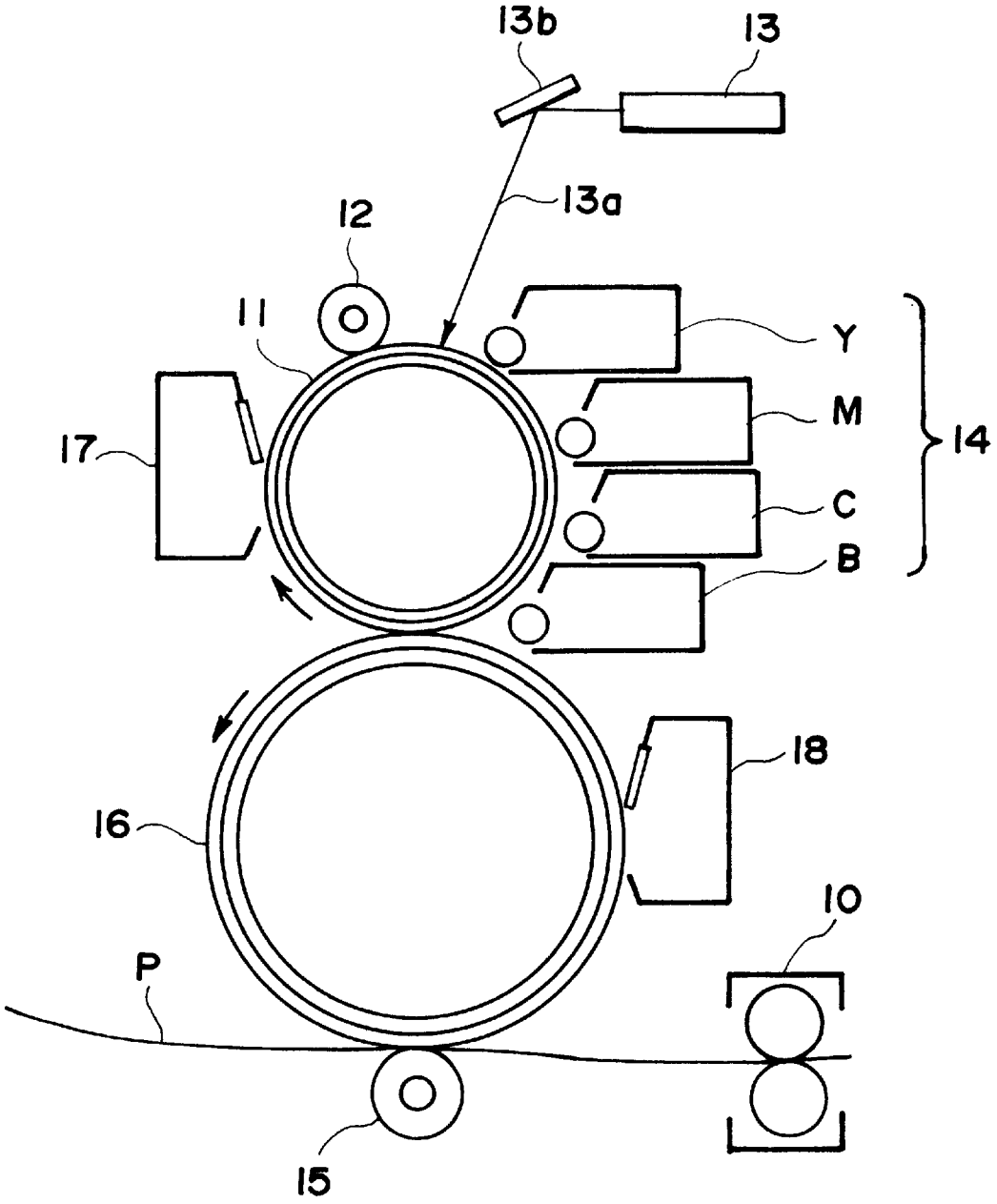
FIG. 8 is a cross section of an image forming apparatus compatible with the embodiment of an image heating apparatus in accordance with the present invention.

FIG. 8 is a cross section of a color image forming apparatus which is based on four primary colors, and employs the embodiment of an image heating apparatus in accordance with the present invention, as a fixing apparatus thereof.

First, the operation of this apparatus will be described.

Reference numeral 11 designates a photosensitive drum; 12, a charging apparatus which uniformly charges the photosensitive drum 11; and a reference numeral 13 designates a laser based optical box which forms an electrostatic latent image on the photosensitive drum 11 by modulating a laser beam with signals from an unillustrated image signal generating apparatus. Reference numerals 13*a* and 13*b* designate a laser beam and a mirror, respectively. The electrostatic latent image formed on the photosensitive drum 11 is visualized by selectively adhering toner to the electrostatic latent image with the use of a developing device 14. The developing device 14 comprises yellow, magenta, and cyan color developing devices Y, M and C, and a black color developing device B In forming a full-color image, an electrostatic latent image is separately formed for each primary color, on the photosensitive drum 11, and is separately developed into a monochromatic color toner image, which is placed in layers on an intermediary transfer drum 16 to create a full-color toner image. The intermediary transfer drum 16 comprises a metallic drum, an elastic middle layer, and a surface layer. The elastic middle layer and the surface layer are placed in this order on the peripheral surface of the metallic drum. The former has an intermediary resistance, and the latter has a high resistance. The full-color toner image on the photosensitive drum 11 is transferred onto the intermediary transfer drum 16 with the use of potential difference between the metallic drums of the intermediary transfer drum 16 and the photosensitive drum 11, which is caused by applying bias voltage to the metallic drum of the intermediary transfer drum 16. Meanwhile, a transfer medium P is fed between a transfer roller 15 and the intermediary transfer drum 16 in synchronism with the arrival of the full-color toner image from the photosensitive drum 11, between the transfer roller 15 and the intermediary transfer drum 16. Then, the full-color toner image on the intermediary transfer drum 16 is transferred from the intermediary transfer roller 16 onto the recording medium P by giving the recording medium P electric charge from the transfer roller 15. In this case, the electric charge given to the recording medium P is opposite in polarity to the toner, and is given from the back side of the recording medium P. Thereafter, the recording medium P carrying the full-color toner image having been simply deposited thereon is put through a thermal fixing apparatus 10, in which the recording medium P and the full-color toner image thereon are subjected to heat and pressure. As a result the full-color toner image on the recording medium P is permanently fixed to the recording medium P. Then, the recording medium P is discharged into an unillustrated delivery tray. The toner particles and the paper dust remaining on the photosensitive drum 11 are removed by a cleaner 17, whereas the toner particles and the paper dust remaining on the intermediary transfer drum 16 are removed by a cleaner 18. Thereafter, the photosensitive drum 11 is used again for the above described image forming steps for the following image formation.

Next, the fixing apparatus, that is, an image heating apparatus, in the first embodiment of the present invention will be described.

Figure 1:
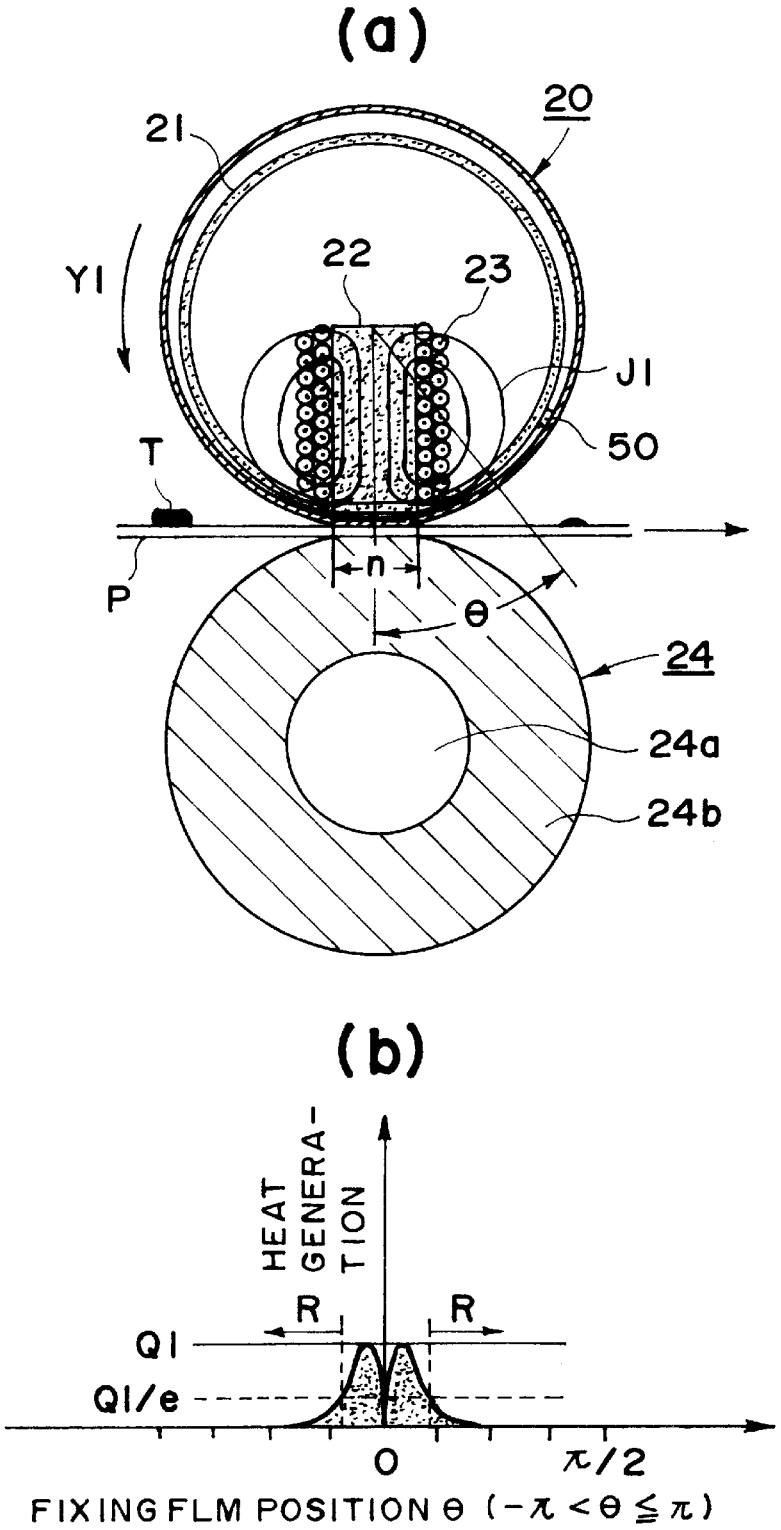
FIG. 1 is a cross section of the thermal fixing apparatus in the first embodiment of the present invention.

FIG. 1, (*a*) is a cross section of the fixing apparatus in the first embodiment of the present invention, and FIG. 1, (*b*) is a graph showing the heat distribution in the fixing apparatus.

Figure 2:
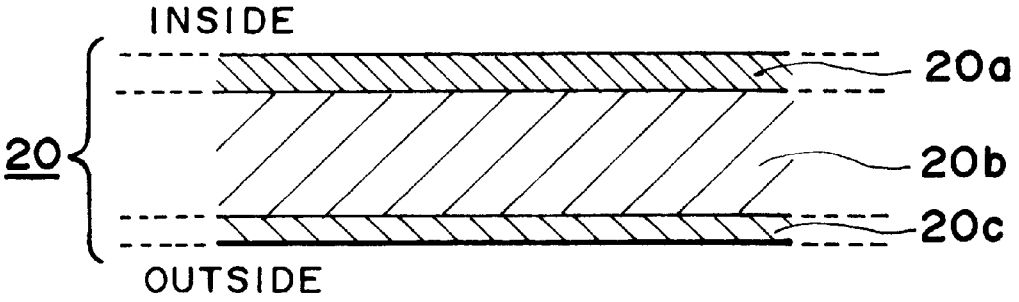
FIG. 2 is an enlarged section of the film in the thermal fixing apparatus illustrated in FIG. 1.

Reference numeral 20 designates a rotational member which moves with a recording medium. In this embodiment, the rotational member is an endless film, which is stably rotated in the direction of an arrow mark Y1, being guided by a film guide, which is placed in contact with a pressure roller to form a fixing station (hereinafter, nip n). The fixing film 20 is put through the nip n, in which it is pressed against the film guide 21. Referring to FIG. 2, the fixing film 20 comprises three layers: a 10–100 $\mu$m thick heat generating layer 20*a* formed of highly magnetic electrically conductive material, for example, nickel, iron, magnetic SUS, or nickel-cobalt alloy; a 100–1000 $\mu$m thick elastic layer 20*b* formed of elastic material, for example, silicon rubber, fluorinated rubber, or fluoro-silicon rubber; and a 1–100 $\mu$m thick separative layer 20*c* formed of highly separative and heat resistant material, for example, fluoro-resin (PFA, PTFE, FEP, or the like), silicone resin, fluoro-silicone rubber, fluorinated rubber, or silicone rubber, which promotes toner separation from the fixing film 20. Thus, the fixing film 21 displays high heat conductivity.

Reference numeral 22 designates a highly permeable magnetic core for guiding magnetic flux. It is formed of magnetic material, for example, ferrite or permalloy, which is used as the material for a transformer. Desirably, the core 22 is formed of such ferrite that sustains little damage even when exposed to a power frequency of 100 kHz or higher.

Reference numeral 23 designates an exciter coil as a means for generating magnetic flux, which is connected to an unillustrated exciter circuit, and generates a magnetic flux J1 as high frequency electric current having a frequency in a range of 20–500 kHz is flowed through it.

Reference numeral 24 designates a pressure roller, which comprises a metallic core 24*a* and a 2–10 mm thick elastic silicon rubber layer 24*b*. It is a backup member which is pressed against the film guide 21, with the film 20 being interposed, to form the nip n.

This pressure roller 24 is rotatively moved by an unillustrated driving member. As a result, the film pinched in the nip n between the film guide 21 and the pressure roller 24 is rotatively moved due to the friction which occurs between the film 20 and the pressure roller 24. In a fixing operation, the recording medium P, as an object to be heated in the nip n, which is carrying a full-color toner image having been simply deposited thereon, is passed through the nip n, in which the full-color toner image is thermally fixed to the recording Medium P. The heating principle in the nip p is as follows.

That is, high frequency current having a frequency in a range of 20–500 kHz is flowed through the coil 23 from the unillustrated exciter circuit to generate magnetic flux, so that eddy current is induced in the heat generating layer 20*a* by the fluctuation of the magnetic flux. The eddy current generates heat due to the presence of the specific resistance of the heat generating layer 20*a*. The thus generated heat heats the recording medium P and the toner T (full-color toner image) on the recording medium P through the elastic layer 30*b* and the separative layer 20*c* while the recording medium P is put through the nip n. Within the nip n, the toner T melts. Then, as the recording medium P comes out of the nip n, the melted toner T cools down and solidifies while fusing with the recording medium P, and becomes a permanent solid image.

Reference numeral 50 designates a temperature detecting member such as a thermistor, which detects the film temperature. The film temperature detected by the temperature detecting member 50 is used by an unillustrated control device to adjust the actual fixing temperature. The temperature detecting member 50 is held by the film guide 21, between the film 20 and the film guide 21, in contact with the inward side of the film 21, and outside the predetermined heat generating region of the film 20. The phrase, "outside the predetermined heat generating region," means the regions R in which the maximum amount Q1 of the heat generated by the film 20 is no more than Q1/e as indicated in FIG. 1, (*b*). In FIG. 1, (*b*), reference character θ represents the angle from the line connecting the centers of the film guide 21 and the pressure roller 24, which is plotted on the axis of abscissa. The amount of the heat generated by the film 20 is plotted on the axis of ordinates. Further, the position of the temperature detecting member 50 is substantially outside the path of a magnetic flux J1 formed through the magnetic core 22 and the exciter coil 23.

As is evident from the above description, in this embodiment, the temperature detecting member 50 is located outside the predetermined heat generating region of the heat generating film 20, and therefore, it is not exposed to the air which is warmed by the heat from the heat generating film 20. Also, it is not affected by the heat generated in the exciter coil 23 itself which is practically in the heat generating region of the heat generating film 20. As a result, it can accurately detect the film temperature.

With the provision of the above-described structure, even when the toner image to be fixed is a full-color toner image composed of a plurality of superposed toner layers of different color, and the recording medium P to which the toner image is to be fixed is a cardboard having been left cold, the toner image is desirably fixed to the recording medium P; it does not occur that the image fails to be fixed to the recording medium P, toward the trailing end of the recording medium P. In other words, the responsiveness of the temperature detecting member 50 to the changes in ambient conditions is guaranteed by placing the temperature detecting member 50 outside the heat generating region of the heat generating film 20. Further, since the heat generating film 20 itself has high heat conductivity, the temperature detecting member 50 can accurately detect the film temperature even though the temperature detecting member 50 is located outside the heat generating region of the heat generating film 20. Therefore, the film temperature can be quickly adjusted by the temperature controlling means in response to the film temperature change caused by the passage of the recording medium P. Thus, even when a full-color toner image is fixed to a cardboard having been left cold, a desirable print which does not show any sign of fixation failure toward the trailing end of the recording medium P can be produced.

Figure 3:
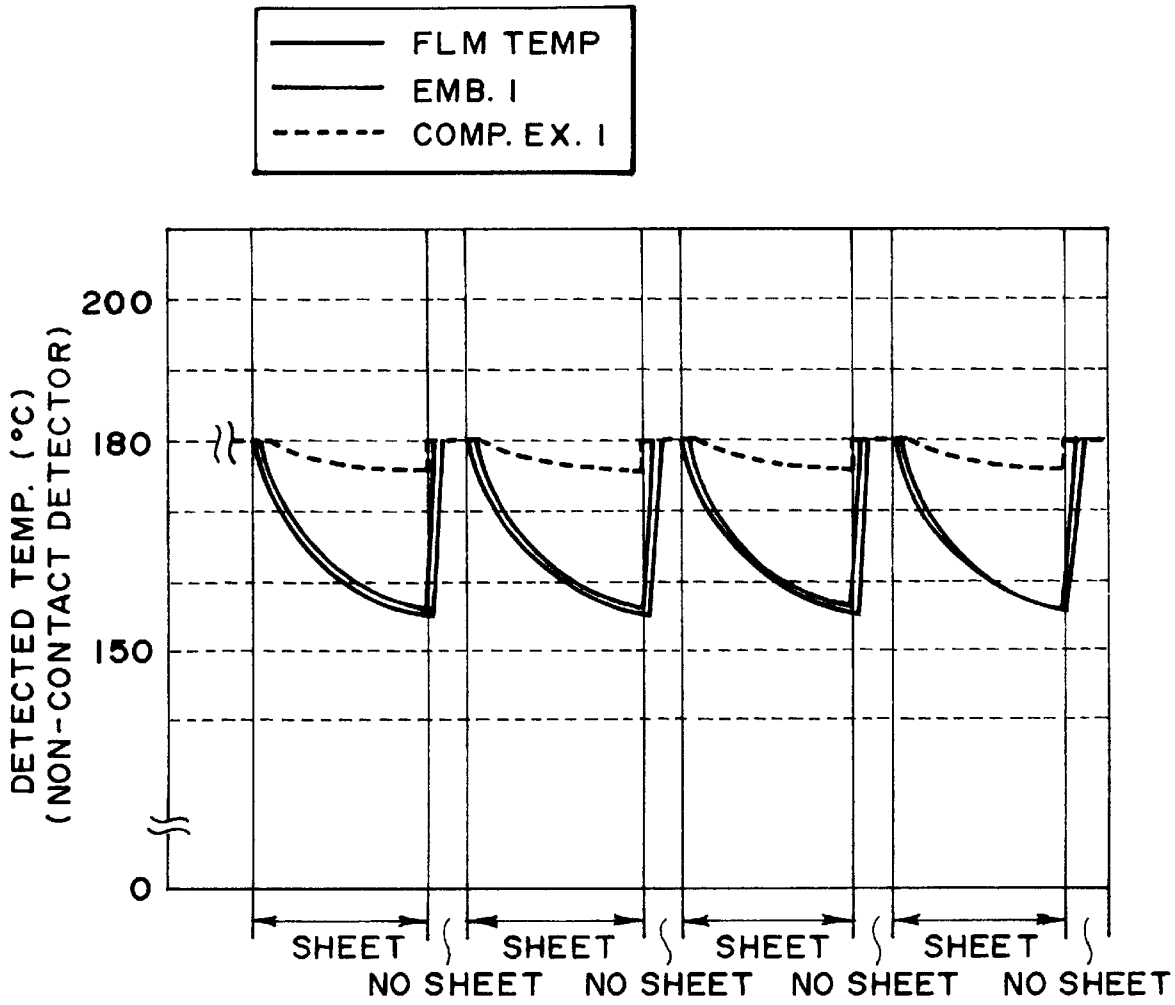
FIG. 3 is a graph showing the film temperature detected by the temperature detecting member of the thermal fixing apparatus in the first embodiment of the present invention.

FIG. 3 is a graph showing the actual temperature change of the heat generating film 20 which occurred when a cardboard having been left cold was passed through the fixing apparatus in the first embodiment of the present invention, and the temperature of the heat generating film 20 which was actually detected by the temperature detecting member 50. It confirms the effectiveness of the first embodiment. It should be noted here that the measurement was made without executing temperature control, while flowing electricity through the exciter coil 23 using a predetermined frequency and a predetermined current rate. The actual temperature of the heat generating film 20 was measured using a noncontact type temperature measuring device. For comparison, the temperature detecting member 50 was positioned within the heat generating region of the heat generating film 20, and the temperature of the heat generating film 20 was measured in the same manner as it was in the case of the first embodiment.

As is evident from the graph, the film 20, the temperature of which had been maintained at a predetermined fixation temperature (180° C.), was robbed of thermal energy due to the passage of a cardboard, and therefore, the film temperature dropped. More specifically, the film temperature dropped as low as 155° C. by the time the trailing end of the cardboard passed through the nip n. Then, the film temperature recovered to the predetermined fixation temperature (180° C.) during each sheet interval. As for the temperature detected by the temperature detecting member 50 in the first embodiment, it substantially stayed with the actual film temperature, proving the satisfactory responsiveness of the temperature detecting member 50 in the first embodiment. In other words, when the image heating apparatus in the first embodiment is employed as an actual fixing device in a color image forming apparatus, it can quickly execute temperature control by instantly responding to the film temperature change caused by the passage of a recording medium P or the like, 60 that the film temperature can be kept steady at the predetermined desirable fixation temperature. On the other hand, in the case of the comparative embodiment in which the temperature detecting member 50 was positioned within the heat generating region of the heat generating film 20, the responsiveness of the temperature detecting member 50 to the film temperature change was unsatisfactory; the temperature detecting member 50 failed to detect the actual film temperature. Therefore, when the recording medium P was a cardboard or the like which had been left cold, an ordinary temperature control could not prevent the fixation failure from occurring toward the trailing end of the recording medium P.

Further, when the image heating apparatus in the preceding embodiment was used as the fixing device in a color image forming apparatus to form a full-color image on a cardboard having had been left cold, the obtained print was a desirable print showing no sign of fixation failure.

Generally speaking, a thermistor, the temperature detecting member, comprises a temperature detecting element (heat sensing portion), electrodes through which electric power is supplied to the temperature detecting element, and an electrically conductive member such as lead wire or the like through which electric power is supplied to the electrodes.

In this embodiment, a thermistor is located outside the path of the magnetic flux, and therefore, it does not occur that heat is generated in the thermistor itself due to the presence of the magnetic flux. Thus, the thermistor in this embodiment can accurately detect the film temperature. Further, the thermistor in this embodiment, being outside the path of the magnetic flux, does not stand in the way of the portion of the magnetic flux which runs through the heat generating film, and therefore, the heat generating film is prevented from generating heat unevenly across the heat generating region thereof.

Figure 4:
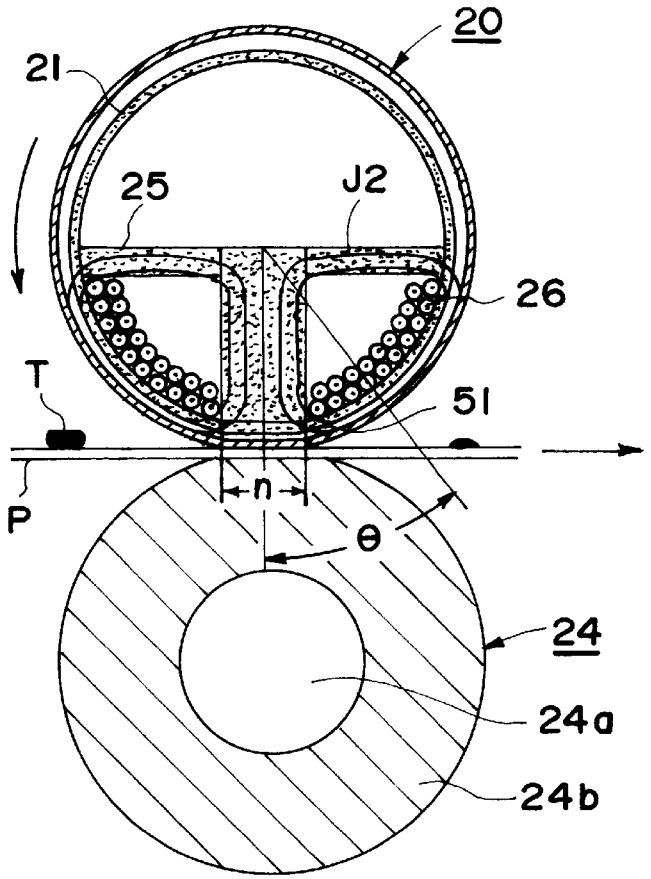
FIG. 4 is a cross section of the thermal fixing apparatus in the second embodiment of the present invention
Figure 4:
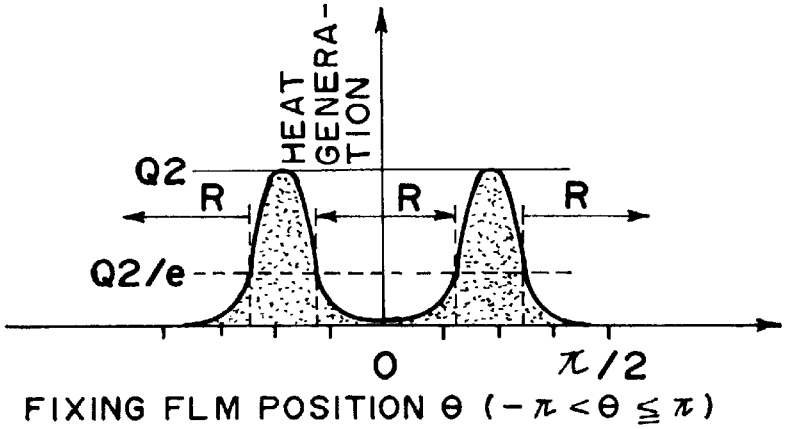

FIG. 4, (*a*) is a cross section of the fixing heating apparatus in the second embodiment of the present invention, and FIG. 4, (*b*) is a graph showing the heat distribution in the fixing apparatus. In these drawings, those items designated by the same referential figures as those in the first embodiment have the same functions as those in the first embodiment.

In this embodiment, in order to improve the heat generating efficiency of an image heating apparatus, a T-shaped core 25 is employed in place of the core 22 in the first embodiment, and a coil 26 is placed on the inward surface of a film guide 21. With the core 25 and the coil 26 arranged in this manner, the magnetic field is generated as indicated by magnetic flux J2, and as a result, the heat generating efficiency is improved.

Also in this embodiment, a thermistor 51 as the temperature detecting member is placed adjacent to the nip n, on the downstream side relative to the rotational direction of a heat generating film 20, outside the predetermined heat generating region of the heat generating film 20.

With this arrangement, the thermistor 51 can accurately detect the film temperature (fixation temperature) while maintaining satisfactory responsiveness to the changes in ambient conditions. In other words, the placing of the thermistor 51 adjacent to the nip n makes it possible to more accurately measure the actual film temperature (fixation temperature), and-further, the placing of the thermistor 51 outside the heat generating region of the heat generating film 20 makes it possible to guarantee satisfactory responsiveness of the thermistor 51 to the film temperature change caused by the passing of a recording sheet or the like.

In particular, since the thermistor 51 in this embodiment is on the downstream side of the nip n relative to the moving direction of the heat generating film 20, the film temperature can be detected immediately after the film 20 is robbed of heat, in the nip n. Therefore, the film temperature can be more accurately adjusted to the proper fixation temperature.

Figure 5:
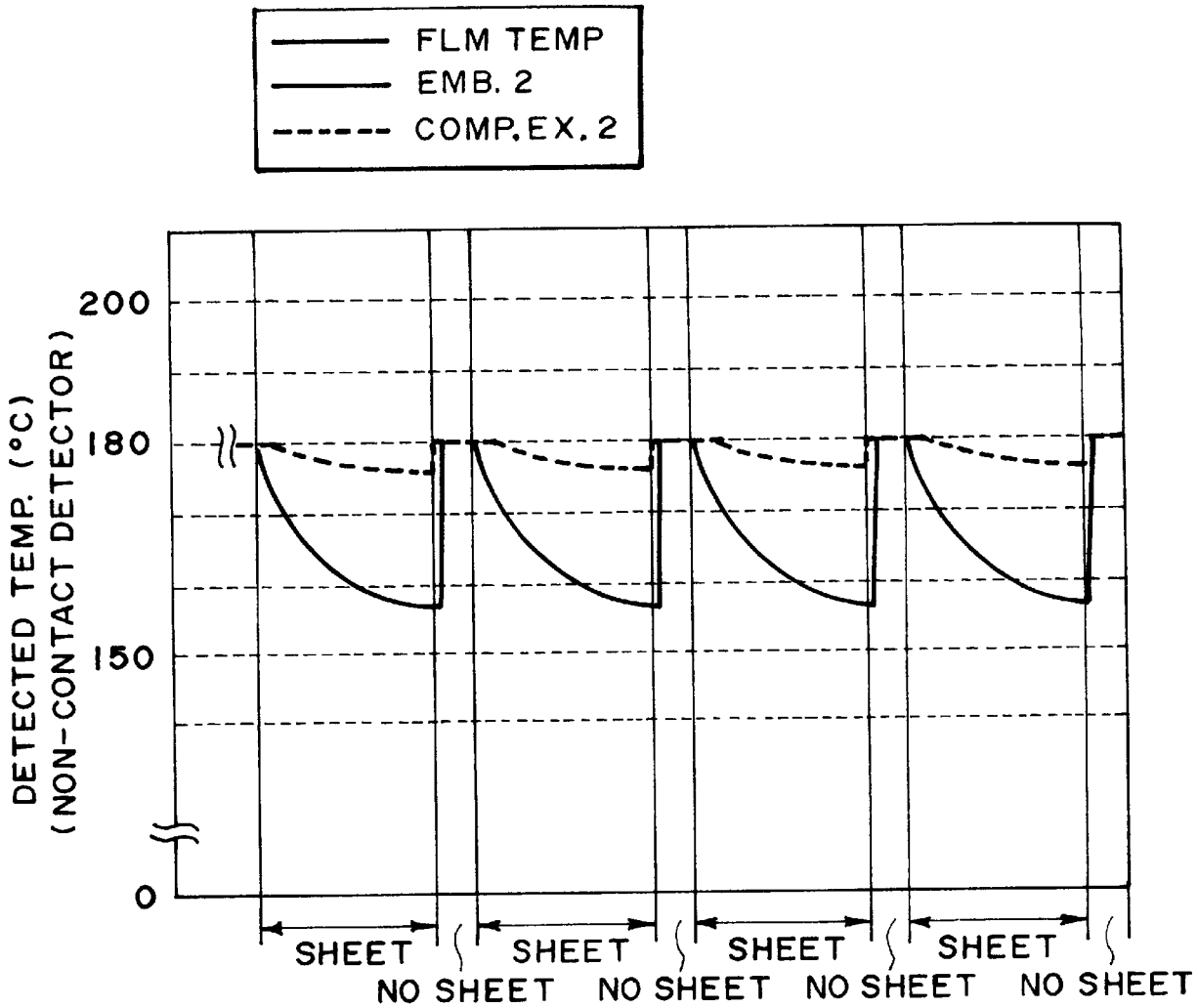
FIG. 5 is a graph showing the film temperature detected by the temperature detecting member of the thermal fixing apparatus in the second embodiment of the present invention.

FIG. 5 shows the film temperature detected by the thermistor 51 in the second embodiment when cardboard sheets having had been left cold were consecutively passed through the nip n while flowing electric current through the exciter circuit at a predetermined frequency. As is evident from the graph, also in this second embodiment, the values of the film temperature detected by the thermistor 51, the temperature detecting member, are substantially the same as the values of the actual film temperature in spite of the fluctuation of the actual film temperature, proving the satisfactory responsiveness of the thermistor 51.

Thus, when the image heating apparatus described in this embodiment is actually employed as a fixing apparatus in an image forming apparatus, temperature control can be instantly executed in response to the film temperature change caused by the passing of a recording medium or the like, so that stable fixation temperature can be always provided. Therefore, even when a full-color image is fixed to a cardboard having been left cold, a desirable print with no sign of fixation failure can be obtained.

When the image heating apparatus in the preceding embodiment was actually used as the fixing device in a color image forming apparatus, and a full-color image was fixed to a cardboard having had been left cold, a desirable print with no sign of image fixation failure could be obtained.

Figure 6:
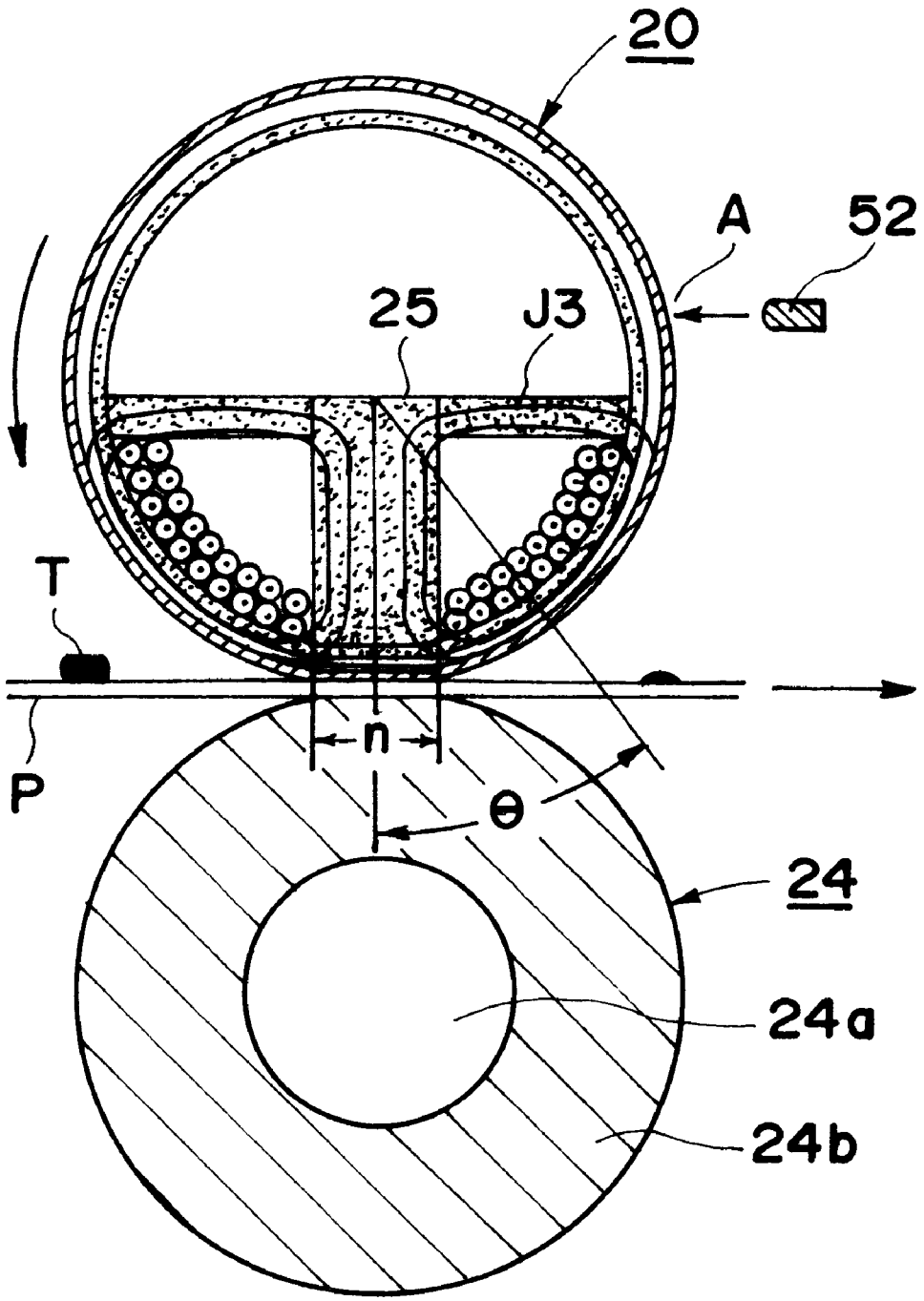
FIG. 6 is a cross section of the thermal fixing apparatus in the third embodiment of the present invention.
Figure 7:
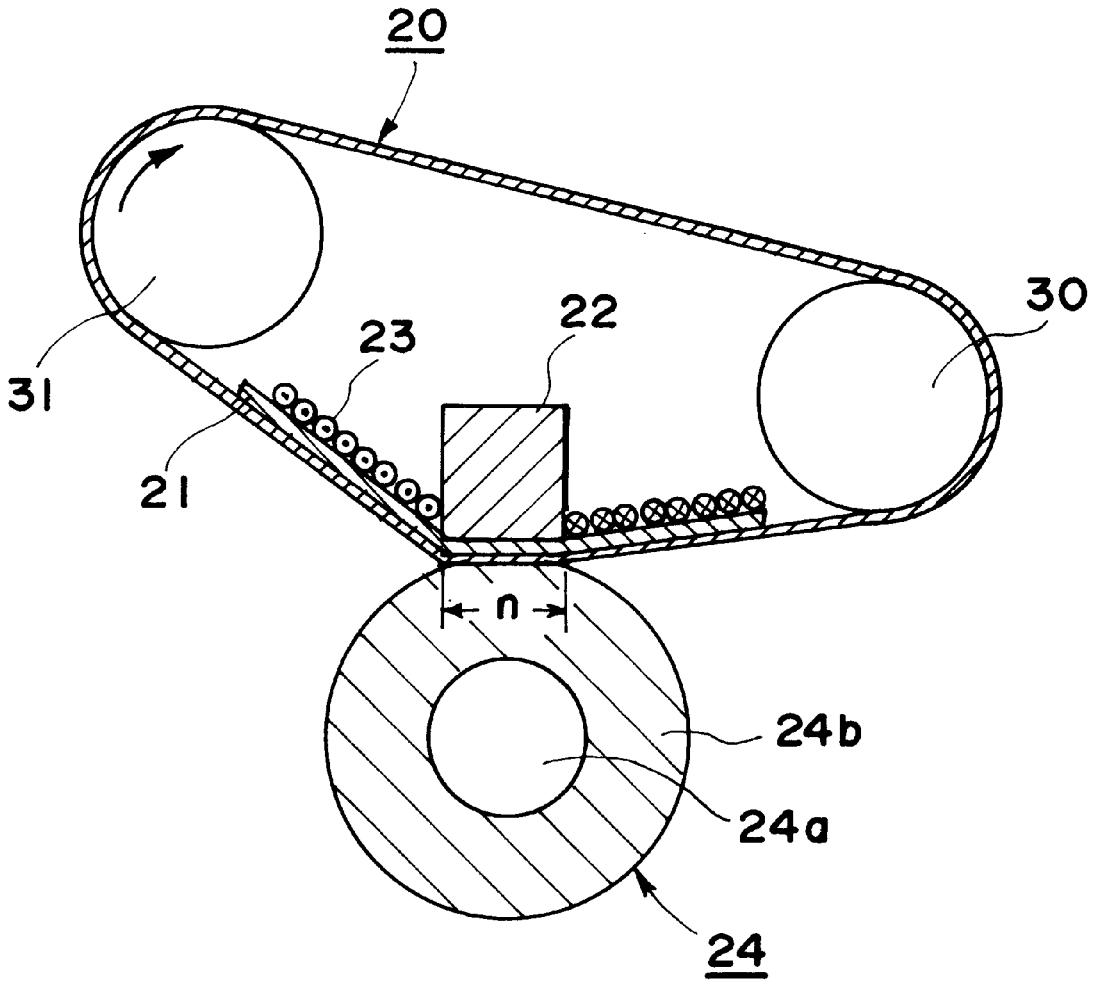
FIG. 7 is a cross section of a modified version of an image heating apparatus to which the present invention is applicable.

FIG. 6 is a cross section of the image heating apparatus in the third embodiment of the present invention. In this third embodiment, a noncontact type thermometer 52, the temperature detecting member, is used in place of the thermistor 51 in the second embodiment. The noncontact type thermometer 52 measures the film temperature at a point A in FIG. 6 to obtain the temperature reading which is used for film temperature control. The point A is outside the magnetic circuit formed by the core, the coil, and the film, that is, off the path of the magnetic flux J3, which is constituted of the heat generating film 20 and the core 25. The core 25 in this embodiment is T-shaped, and forms two loops of the magnetic flux path, in cooperation with the heat generating film 20, one on the upstream side of the nip n, and the other on the downstream side of the nip n, relative to the rotational direction of the heat generating film 20. Further, the noncontact type thermometer 52, the temperature detecting member, in this embodiment is also located outside the region in which heat is generated in the thermometer itself.

With the provision of the above structure, the film temperature is detected at a point outside the magnetic circuit. Therefore, responsiveness to the changes in ambient conditions is assured. Further, since the film itself has high heat conductivity, even the film temperature measurement point in this embodiment is satisfactory to accurately detect the actual fixation temperature (film temperature).

Further, should the temperature detecting member in this embodiment have electrical conductivity, it is prevented from generating heat in itself, and also from blocking the magnetic flux from entering the heat generating film 20, because it is located away from the magnetic flux path as is the temperature detecting member in the first embodiment. Therefore, the heat generating film 20 generates heat evenly across the heat generating region thereof, and the temperature detecting member can accurately detect the film temperature.

Although in the preceding embodiment, the present invention was described with reference to the image heating apparatuses in which the pressure roller was driven to drive the film using the friction which occurs in the nip, when the present invention was applied to an image heating apparatus (fixing apparatus) employing a film driving system in which a heat generating film 20 was tensioned by a tension roller 30 and was driven by a driving roller 31, the same satisfactory effects as those described above could be obtained.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a movable member which is movable with a recording material;

magnetic flux generating means for generating a magnetic flux, wherein the magnetic flux generated by said magnetic flux generating means generates an eddy current which in turn generates heat in said movable member to heat an image on a recording material; and a temperature detecting member for detecting a temperature of said movable member, wherein said temperature detecting member is provided outside a predetermined heat generation region of said movable member and a heating value at a portion outside the predetermined heat generation region is not more than a maximum heating value of said movable member multiplied by 1/e.

2. An apparatus according to claim 1, wherein said movable member is a hollow rotatable member, and said temperature detecting member is contacted to an inner surface of said rotatable member.

3. An apparatus according to claim 1, wherein said movable member is an endless film.

4. An apparatus according to claim 3, further comprising a guiding member for guiding said film, and said temperature detecting member is supported on said guiding member.

5. An apparatus according to claim 3, wherein said film has an electroconductive layer.

6. An apparatus according to claim 5, wherein said electroconductive layer is highly thermoconductive.

7. An apparatus according to claim 1, wherein said magnetic flux generating means has an excitation coil.

8. An apparatus according to claim 1, further comprising a back-up member for cooperating with said movable member to form a nip.

9. An apparatus according to claim 8, wherein said temperature detecting member is disposed adjacent to said nip downstream of said nip with respect to a movement direction of said movable member.

10. An apparatus according to claim 8, wherein said movable member is a film, and said apparatus further comprises a guiding member for guiding said film, and said back-up member is press-contacted to said guiding member through said film.

11. An apparatus according to claim 8, wherein the recording material carrying an unfixed image is passed through said nip so that unfixed image is fixed on the recording material.

12. An apparatus according to claim 11, wherein the unfixed image is a toner image having a plurality of laminated different color toners, and a color image is provided by mixture of the toners and by fixing the mixture on the recording material.

13. An apparatus according to claim 1, wherein said temperature detecting member is a thermister, and a temperature of said movable member is controlled to be a predetermined level by an output of said thermister.

14. An apparatus according to claim 1, wherein said movable member is contacted to an unfixed image on the recording material.

15. An image heating apparatus, comprising:

a movable member which is movable with a recording material;

an excitation coil for generating a magnetic flux, wherein the magnetic flux generated by said excitation coil generates an eddy current which in turn generates heat in said movable member to heat an image on a recording material;

a magnetic member for guiding the magnetic flux generated by said excitation coil; and a temperature detecting member for detecting a temperature of said movable member, wherein said temperature detecting member is provided substantially outside a magnetic flux path formed by said movable member and said magnetic member and a heating value at a portion outside said magnetic flux path is not more than a maximum heating value of said movable member multiplied by 1/e.

16. An apparatus according to claim 15, wherein said temperature detecting member is a thermister, which has an electroconductive temperature detection portion, electrode portion and a lead portion.

17. An apparatus according to claim 15, wherein a temperature of said movable member is controlled to be a predetermined level by an output of said thermister.

18. An apparatus according to claim 15, wherein said movable member is an endless film.

19. An apparatus according to claim 18, wherein said film has an electroconductive layer.

20. An apparatus according to claim 19, wherein said electroconductive layer is highly thermoconductive.

21. An apparatus according to claim 15, further comprising a back-up member for cooperating with said movable member to form a nip.

22. An apparatus according to claim 21, wherein said movable member is a film, and said apparatus further comprises a guiding member for guiding said film, and said back-up member is press-contacted to said guiding member through said film.

23. An apparatus according to claim 21, wherein the recording material carrying an unfixed image is passed through said nip so that the unfixed image is fixed on the recording material.

24. An apparatus according to claim 23, wherein the unfixed image is a toner image having a laminated different color toner a , and a color image is provided by mixture of them by fixing.

25. An apparatus according to claim 15, wherein said temperature detecting member contacts the movable member.

26. An apparatus according to claim 15, wherein said movable member is contacted to an unfixed image on the recording material.

27. An image heating apparatus, comprising:

an endless film which is movable with a recording material;

magnetic flux generating means for generating a magnetic flux, wherein the magnetic flux generated by said magnetic flux generating means generates an eddy current which in turn generates heat in said film to heat an image on a recording material;

a temperature detecting member for detecting a temperature of said film; and a guiding member for guiding said film, wherein said temperature detecting member is provided outside a predetermined heat generation region of said film, and said temperature detecting member is supported on said guiding member.

28. An image heating apparatus, comprising:

an endless film which is movable with a recording material;

magnetic flux generating means for generating a magnetic flux, wherein the magnetic flux generated by said magnetic flux generating means generates an eddy current which in turn generates heat in said film to heat an image on a recording material;

a temperature detecting member for detecting a temperature of said film; and a guiding member for guiding said film, wherein said temperature detecting member is supported on said guiding member.

29. An apparatus according to claim 28, wherein said magnetic flux generating means has a magnetic member for guiding the magnetic flux, and said temperature detecting member is provided substantially outside a magnetic flux path formed by said film and said magnetic member.

30. An apparatus according to claim 29, wherein a heating value at a portion outside said magnetic flux path is not more than a maximum heating value of said film multiplied by 1/e.

31. An apparatus according to claim 28, wherein said temperature detecting member is provided on such a side of said guiding member so as to be contacted to said film.

* * * * *

UNITED STATES PATENT AND TRADEMARK OFFICE

CERTIFICATE OF CORRECTION

PATENT NO. : 5,940,655

DATED : August 17, 1999

INVENTOR(S): TETSUYA SANO, ET AL.

It is certified that error appears in the above-identified patent and that said Letters Patent is hereby corrected as shown below:

COLUMN 3,
Line 5, "B" should read --B.--.

COLUMN 4,
Line 33, "Medium" should read --medium--.

COLUMN 6,
Line 7, "60" should read--so--.

COLUMN 7,
Line 3, "and-further," should read --and further,--.

COLUMN 9,
Line 11, "thermister," should read --thermistor,--;
Line 13, "thermister." should read --thermistor.--;
Line 37, "thermister," should read --thermistor,--; and
Line 40, "claim 15," should read --claim 16,--.
Line 42, "thermister," should read --thermistor,--

UNITED STATES PATENT AND TRADEMARK OFFICE

CERTIFICATE OF CORRECTION

PATENT NO. : 5,940,655

DATED : August 17, 1999

INVENTOR(S): TETSUYA SANO, ET AL.

It is certified that error appears in the above-identified patent and that said Letters Patent is hereby corrected as shown below:

COLUMN 10,

Line 5, "toner a," should read --toner s,--.

Signed and Sealed this

Twenty-fifth Day of April, 2000

*Attest:*

Q. TODD DICKINSON

*Attesting Officer*

*Director of Patents and Trademarks*